US010490166B2

(12) United States Patent
Bismilla

(10) Patent No.: US 10,490,166 B2
(45) Date of Patent: Nov. 26, 2019

(54) SYSTEM AND METHOD FOR DETERMINING A DISPLAY ORIENTATION OF A MOBILE DEVICE

(75) Inventor: Yamin Bismilla, Brampton (CA)

(73) Assignee: BlackBerry Limited, Waterloo, Ontario (CA)

( * ) Notice: Subject to any disclaimer, the term of this patent is extended or adjusted under 35 U.S.C. 154(b) by 856 days.

(21) Appl. No.: 13/544,021

(22) Filed: Jul. 9, 2012

(65) Prior Publication Data

US 2014/0009498 A1 Jan. 9, 2014

(51) Int. Cl.
*G09G 5/34* (2006.01)
*G09G 5/36* (2006.01)

(52) U.S. Cl.
CPC ..... *G09G 5/363* (2013.01); *G09G 2340/0492* (2013.01); *G09G 2380/16* (2013.01)

(58) Field of Classification Search
CPC ..... G06F 2200/1614; G06F 1/1626; G06F 1/1616; G06F 1/00; G06F 9/44; G06F 9/4443; G06F 1/1694; G09G 5/00; G09G 2354/00; G09G 2340/0492; G09G 5/14; G09G 2300/023; G09G 5/34; G09G 2380/16; G09G 5/363; B01L 2200/0642; A61G 2007/0527; G06K 9/00248; G06K 9/3208; G05B 2219/31318; G01M 15/02; B29D 11/00673; G06T 3/0006; G06T 3/00; G06T 2207/10016; G06T 2207/10021; G06T 2207/10028; G06T 7/74; G01C 21/3697; G01C 21/3626; H04B 1/3833
USPC ..... 345/650
See application file for complete search history.

(56) References Cited

U.S. PATENT DOCUMENTS 8,717,285 B1 * 5/2014 White ..... G06F 3/0346 345/156
2008/0165144 A1 7/2008 Forstall et al.
2008/0211778 A1 9/2008 Ording et al.
2010/0153891 A1 * 6/2010 Vaananen et al. ..... 715/864
2012/0038546 A1 2/2012 Cromer et al.
2012/0098765 A1 4/2012 Söderström et al.
2012/0262372 A1 * 10/2012 Kim et al. ..... 345/158
(Continued)

FOREIGN PATENT DOCUMENTS

EP 2241963 A1 10/2010
JP WO2012/004852 * 1/2012

OTHER PUBLICATIONS

Openmoko, Gestures; http://wiki.openmoko.org/wiki/Gestures; available on the Internet as early as Aug. 14, 2008; retrieved from the Internet May 14, 2012.

(Continued)

*Primary Examiner* — Yi Wang
(74) *Attorney, Agent, or Firm* — Thomas Grzesik; Fleit Intellectual Property Law

(57) ABSTRACT

A method and system are provided for determining a display orientation of a mobile device. The mobile device is configured to change the display orientation when a first input is detected. The first input corresponds to a change in orientation of the mobile device that satisfies one or more first criteria. The method includes detecting the first input and enabling a second input to change the display orientation when detected within a predetermined period of time after detecting the first input, the second input satisfying one or more second criteria different from the one or more first criteria.

12 Claims, 14 Drawing Sheets

(56) References Cited

U.S. PATENT DOCUMENTS

| | | | | |
|---|---|---|---|---|
| 2013/0120256 | A1* | 5/2013 | Ishidera | G09G 3/20 345/158 |
| 2013/0335333 | A1* | 12/2013 | Kukulski et al. | 345/173 |

OTHER PUBLICATIONS

Ashbrook, Daniel et al; Magic: A Motion Gesture Design Tool; Proceedings of the 28th International Conference on Human Factors in Computing Systems; Apr. 10-15, 2010; Atlanta, Georgia, USA.
Krish, Varun, Gesture UI Key on the LG Optimus Black Demo!; http:www.fonearena.com/blog/31525/gesture-ui-key-on-the-lg-optimus-black-demo.html; available on the Internet as early as Feb. 23, 2011l; retrieved from the Internet May 14, 2012.
Costello, Sam, Shake to Shuffle on iPhone OS3.0, iPod nano; http://ipod.about.com/od/iphone3gs/qt/shake-to-shuffle-iphone.htm; retrieved from the Internet May 14, 2012.
Costello, Sam, Shake to Undo on iPhone; http://ipond.about.com/od/iphonehowtos/qt/Shake-To-Undo-On-lphone. htm; retrieved from the Internet May 14, 2012.
Varatharajan, Sathishkumar, Toggle Your Auto-Rotation With Shake 'n Rotate; http://www.bestandroidblog.com/applications/toggle-you-auto-rotation-with-sahke-n-rotate; retrieved from the Internet Jan. 21, 2013.
Davenport, Kevin, Search Report from corresponding European Application No. 12175511; search completed Oct. 17, 2012.

* cited by examiner

SYSTEM AND METHOD FOR DETERMINING A DISPLAY ORIENTATION OF A MOBILE DEVICE

TECHNICAL FIELD

The following relates generally to determining a display orientation of a mobile device.

DESCRIPTION OF THE RELATED ART

Many electronic devices, including mobile devices, can be positioned in multiple orientations. More recently, mobile devices can change the display orientation (i.e. orientation of the screen shown on a display of a mobile device) in response to a change in the orientation of the mobile device. For example, a mobile device positioned in a portrait orientation may display content in a corresponding portrait orientation. When the mobile device is rotated, for example by 90° onto one side, the mobile device may automatically change the display orientation to a landscape orientation.

BRIEF DESCRIPTION OF THE DRAWINGS

Embodiments will now be described by way of example only with reference to the appended drawings wherein.

DETAILED DESCRIPTION

Figure 1:
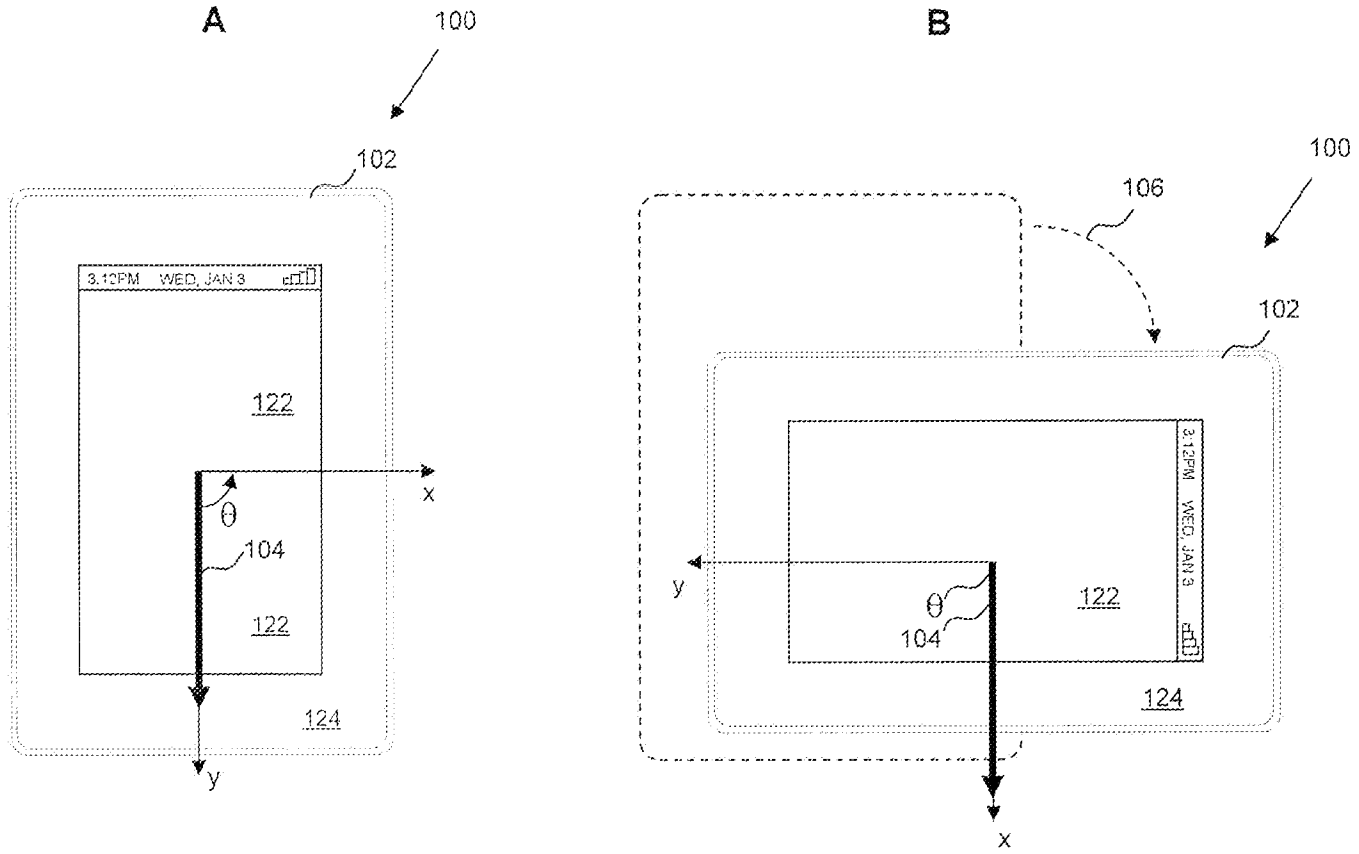
FIG. 1 is a plan view of an example of a mobile device in different orientations.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practised without these specific details. In other instances, well-known methods, procedures and components have not been described in detail so as not to obscure the example embodiments described herein. Also, the description is not to be considered as limiting the scope of the example embodiments described herein.

Electronic devices, including tablet computers and other mobile devices, may automatically change display orientations based on a detected orientation of the mobile device. For example, rotating a mobile device from a portrait orientation to a landscape orientation may cause the display orientation to change in a similar manner to maintain a particular orientation of the screen relative to a reference direction, such as the vertical direction of the Earth (e.g. gravity). Such a change in the display orientation may also align the screen with the orientation of a user since the user may be aligned with the vertical reference direction (e.g. user is standing up), thus making the display more convenient to view for the user.

However, in some cases, the mobile device may not automatically change display orientations despite the fact that a change in the orientation of the mobile device has occurred. This may be due to an error, inaccuracy or limitation in detecting the orientation of the mobile device and/or in the software responsible for controlling the display orientation.

In other cases, a mobile device may change the display orientation to an orientation that is more difficult to view by a user, especially if the user is lying down, inverted or otherwise not aligned with the reference direction used to change the display orientation. As a result, a user may not want the display orientation to change in certain circumstances, even if the mobile device has changed orientations.

Therefore, it has been recognized that methods of determining a display orientation on a mobile device may be limited. To address this, the following describes a method, computer readable storage medium and mobile device operable to determine a display orientation of the mobile device.

In one aspect there is provided a method of determining a display orientation of a mobile device. The mobile device is configured to change the display orientation when a first input is detected. The first input corresponds to a change in orientation of the mobile device that satisfies one or more first criteria. The method includes detecting the first input and enabling a second input to change the display orientation when detected within a predetermined period of time after detecting the first input, the second input satisfying one or more second criteria different from the one or more first criteria.

In another aspect, there is provided a computer readable storage medium for determining a display orientation of a mobile device. The mobile device is configured to change the display orientation when a first input is detected. The first input corresponds to a change in orientation of the mobile device that satisfies one or more first criteria. The computer readable storage medium includes computer executable instructions for detecting the first input and enabling a second input to change the display orientation when detected within a predetermined period of time after detecting the first input, the second input satisfying one or more second criteria different from the one or more first criteria.

In another aspect, there is provided a mobile device that includes a processor and memory. The mobile device is configured to change the display orientation when a first input is detected. The first input corresponds to a change in orientation of the mobile device that satisfies one or more first criteria. The memory stores computer executable instructions for detecting the first input and enabling a second input to change the display orientation when detected within a predetermined period of time after detecting the first input, the second input satisfying one or more second criteria different from the one or more first criteria.

Referring to FIG. 1, a plan view of an example embodiment of an electronic device, such as a mobile device 100, moving from a portrait orientation to a landscape orientation through a clockwise rotation 106 is shown. In this example, the mobile device 100 includes a touch-sensitive display 102. The touch-sensitive display 102 may include a touch-sensitive non-display area 124 surrounding a touch-sensitive display area 122, both of which may be capable of receiving inputs in the form of touch gestures. In other example embodiments, the mobile device 100 may include a non touch-sensitive display in addition to, or in replacement of, the touch-sensitive display 102.

The mobile device 100 has a frame of reference, such as the xyz axes of the Cartesian co-ordinate system. In this example, the x axis is parallel to the length of the mobile device 100, the y axis is parallel to the width of the mobile device 100 and the z axis is perpendicular to the plane defined by the touch-sensitive display 102 (not shown as it points into the page). As the mobile device 100 changes orientation, the x, y and z axes remain fixed with respect to the mobile device 100.

In an example embodiment, the orientation of the mobile device 100 can be determined with respect to a frame of reference, such as the Earth's frame of reference. For example, the mobile device 100 can detect its orientation by determining the angle θ between a fixed reference direction 104, such as the Earth's gravity, and the x axis of the mobile device 100.

At position A, both the mobile device 100 and the touch-sensitive display area 122 are orientated in a portrait orientation. The mobile device 100 can detect the portrait orientation of the mobile device 100 by obtaining the gravity reference direction 104 (e.g. from an accelerometer) and checking that the gravity reference direction 104 is substantially parallel to the xy plane and at an angle θ of approximately 90 degrees to the x axis.

The mobile device 100 is rotated clockwise from position A to position B. The mobile device can detect the change in orientation of the mobile device 100 by detecting a corresponding change in the angle θ. For example, the reduction in the angle θ from approximately 90 degrees to 0 degrees can indicate that the mobile device 100 has rotated from a portrait orientation to a landscape orientation.

The mobile device 100 can be configured to change the display orientation when a first input is detected. The first input can take on the form of a change in orientation of the mobile device 100, such as the change in orientation from a portrait orientation (e.g. position A) to a landscape orientation (e.g. position B). In an example, the mobile device 100 may detect such a change by determining when the angle θ decreases below a certain value, such as 30 degrees.

In some cases, such as the example of FIG. 1, the mobile device 100 may not change the display orientation at position B despite the fact that the criteria to change the display orientation has been satisfied (e.g. angle θ is less than 30 degrees). As a result, the display orientation at position B remains in the portrait orientation, which may not provide an optimal viewing orientation to a user.

Figure 2:
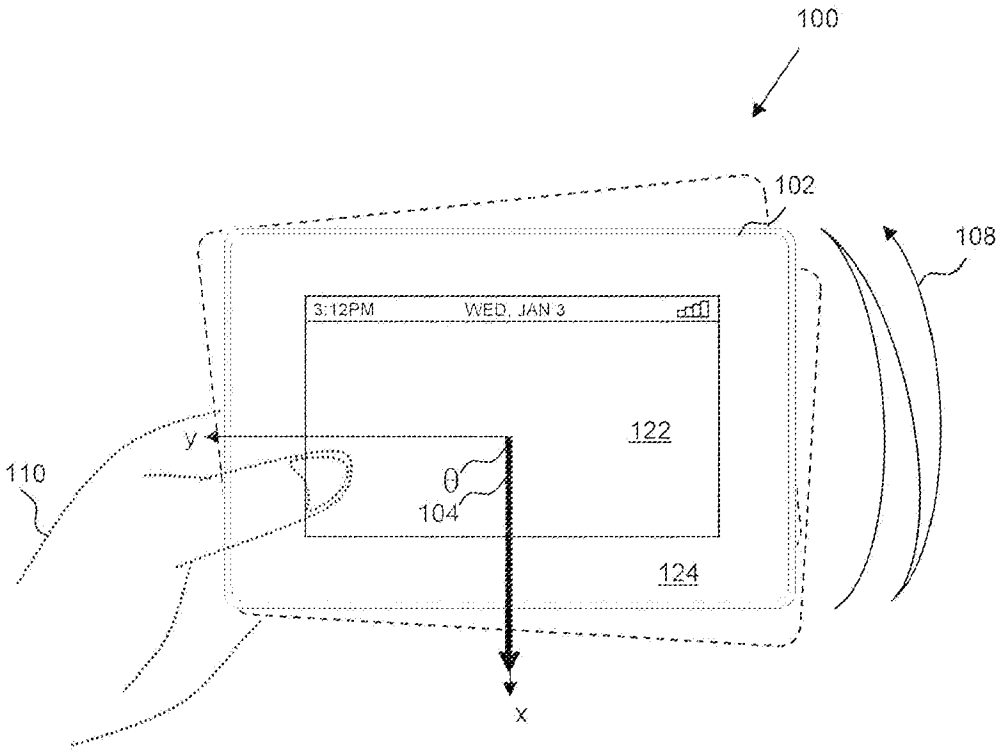
FIG. 2 is a plan view of an example of a mobile device receiving an input in the form of a shaking motion.

The mobile device 100 can be configured to enable a second input to change the display orientation when detected within a predetermined period of time after the first input. For example, the second input can take on the form of a shaking motion 108, as shown in FIG. 2. The shaking motion 108 can be determined by detecting a fluctuation in the angle θ about the 0 degree value. Upon detecting the shaking motion 108, the display orientation of the touch-sensitive display area 122 can change to a landscape orientation. The second input provides another type of input to trigger a change in the display orientation of the mobile device.

In the example of FIGS. 1 and 2, the second input can correct the absence of a change in the display orientation in response to the first input. The second input (e.g. shaking motion 108) can have a smaller range than the first input (e.g. rotation 106) so that the second input can be quickly performed. Configuring the second input to be different from and more easily performed than the first input can also avoid having to reverse and repeat the first input in an attempt to trigger a change in the display orientation, which may be time consuming and frustrating to a user.

Further, the limited movement of the second input, such as a shaking motion 108, may be intuitive and natural to a user, when trying to trigger a change in the display orientation to correct a perceived error in the display orientation (i.e. failure to change the display orientation in response to the first input). For example, a shaking motion 108, can be performed by a hand 110 of the user that is holding the mobile device 100.

In an example, the second input can only trigger a change in the display orientation if detected within a short period of time after detecting the first input. When the second input does not proceed within a predetermined period of time after the first input, the second input may be used to perform other functions not related to changing the display orientation or may be ignored. This can reduce the likelihood that the display orientation changes by inadvertently performing the second input.

In another example, the second input can provide an input that can be quickly performed, even if the first input triggers a change in the display orientation. The first input may trigger a change in the display orientation that is not desired by the user and a limited movement, such as a shaking motion 108, may be intuitive and natural to a user to perform, when trying to return to the previous display orientation without having to perform the reverse motion of the first input.

It can therefore be seen that a mobile device 100 can be configured to provide a second input to change the display orientation of a mobile device 100. The second input may be used to correct a failure to change the display orientation or to reverse a prior change in the display orientation.

Examples of applicable mobile electronic devices may include, without limitation, cellular phones, smart-phones, tablet computers, wireless organizers, personal digital assistants, computers, laptops, handheld wireless communication devices, wirelessly enabled notebook computers, portable gaming devices, and the like. Such devices will hereinafter be commonly referred to as "mobile devices" 100 for the sake of clarity. It will however be appreciated that the principles described herein are also suitable to other electronic devices, e.g. "non-mobile" devices. For example, the principles herein are equally applicable to personal computers (PCs), tabletop computing devices, wall-mounted screens such as kiosks, or any other computing device.

The mobile device 100 may be a two-way communication device with advanced data communication capabilities including the capability to communicate with other mobile devices or computer systems through a network of transceiver stations. The mobile device may also have the capability to allow voice communication. Depending on the functionality provided by the mobile device, it may be referred to as a data messaging device, a two-way pager, a cellular telephone with data messaging capabilities, a wireless Internet appliance, or a data communication device (with or without telephony capabilities).

Figure 3:
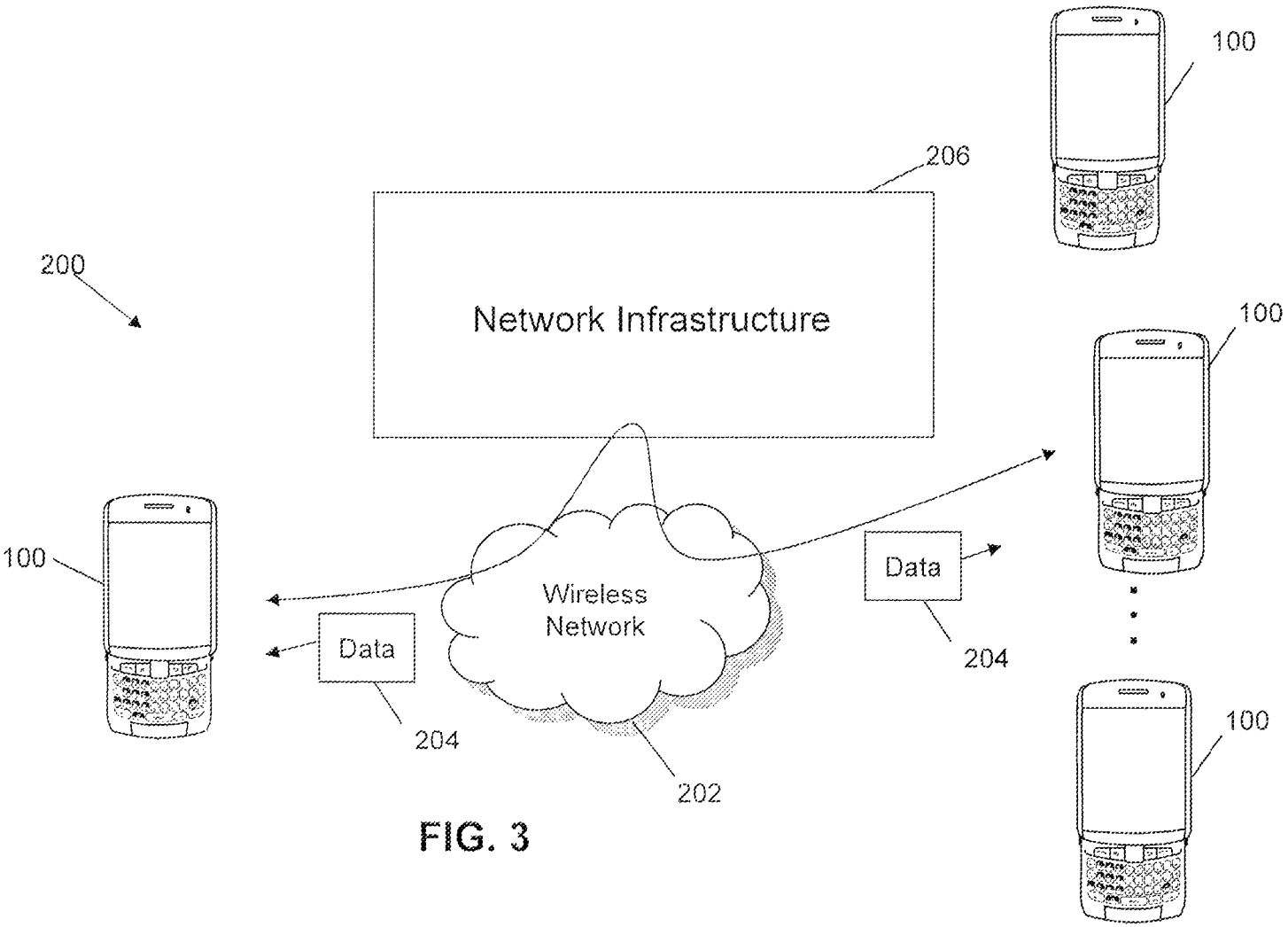
FIG. 3 is a diagram of an example of a wireless communication system.

Referring to FIG. 3, an example communication system 200 is shown. The communication system 200, in this example, enables, at least in part, mobile devices 100 to communicate with each other via a wireless network 202. For example, as shown, data 204 may be exchanged between various mobile devices 100. Data 204 that is sent from one mobile device 100 to another mobile device 100 may be transmitted according to a particular messaging or communication medium, protocol, or other mechanism. For example, as shown in FIG. 3, data 204 may be sent over the wireless network 202 via a component of a network infrastructure 206. The network infrastructure 206 can include various systems that may be used by the mobile devices 100 to exchange data 204. For example, a peer-to-peer (P2P) system, a short message service centre (SMSC), an email system (e.g., web-based, enterprise based, or otherwise), a web system (e.g. hosting a website or web service), a host system (e.g. enterprise server), and social networking system may be provided by or within or be otherwise supported or facilitated by the network infrastructure 206. The mobile devices 100 may therefore send data to or receive data from other mobile devices 100 via one or more particular systems with which the mobile devices 100 are communicable via the wireless network 202 and network infrastructure 206.

Figure 4:
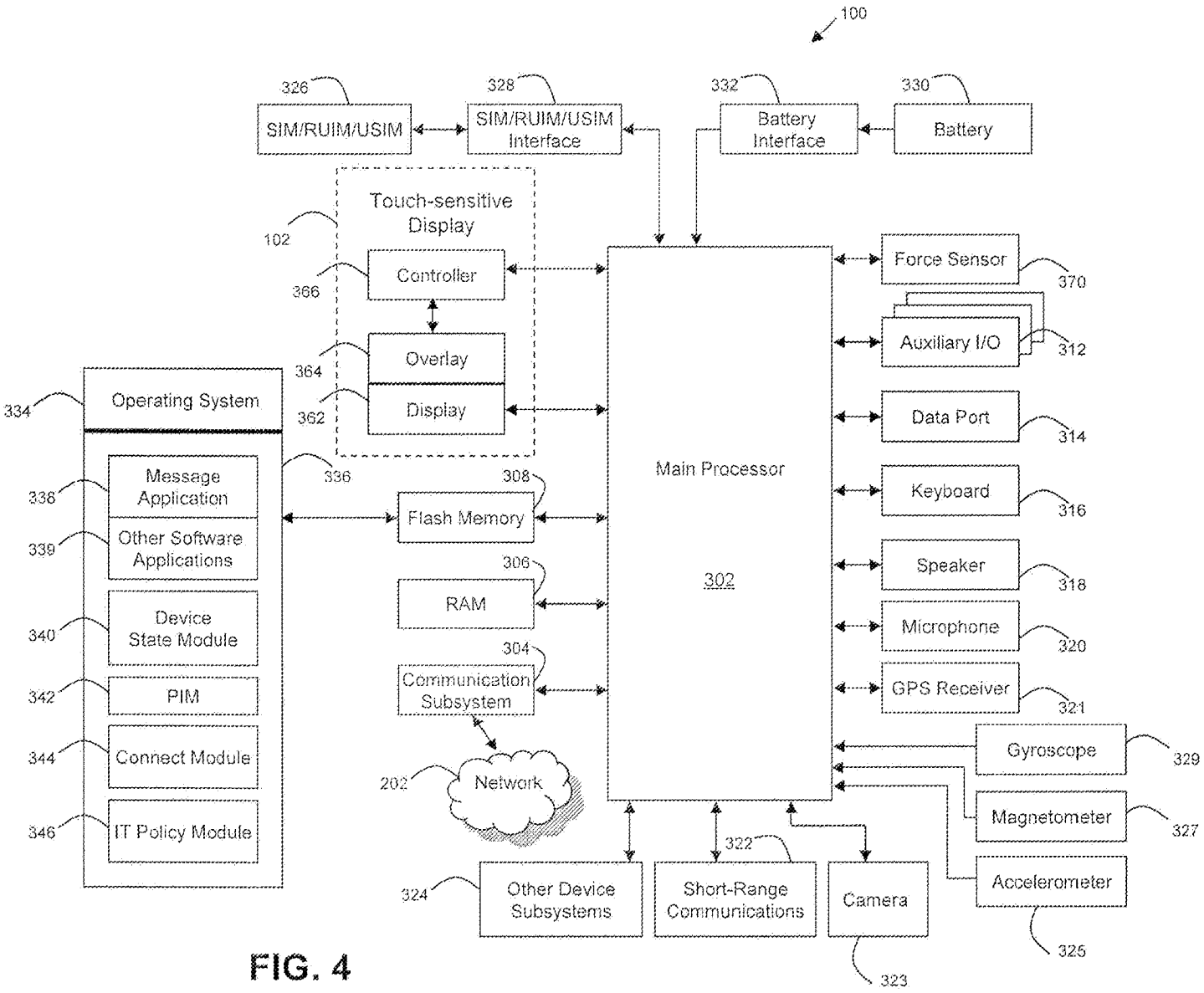
FIG. 4 is a diagram of an example of a mobile device.

To aid the reader in understanding an example configuration of a mobile device 100, reference will be made to FIG. 4, which illustrates a diagram of an example of a mobile device 100. The mobile device 100 includes a number of components such as a main processor 302 that controls the overall operation of the mobile device 100. Communication functions, including data and voice communications, are performed through a communication subsystem 304. The communication subsystem 304 receives messages from and sends messages to a wireless network 202. In this example of the mobile device 100, the communication subsystem 304 is configured in accordance with the Global System for Mobile Communication (GSM) and General Packet Radio Services (GPRS) standards, which is used worldwide. Other communication configurations that are equally applicable are the 3G and 4G networks such as Enhanced Data-rates for Global Evolution (EDGE), Universal Mobile Telecommunications System (UMTS) and High-Speed Downlink Packet Access (HSDPA), Long Term Evolution (LTE), Worldwide Interoperability for Microwave Access (Wi-Max), etc. New standards are still being defined, but it is believed that they will have similarities to the network behaviour described herein, and it will also be understood by persons skilled in the art that the example described herein are intended to use any other suitable standards that are developed in the future. The wireless link connecting the communication subsystem 304 with the wireless network 202 represents one or more different Radio Frequency (RF) channels, operating according to defined protocols specified for GSM/GPRS communications.

The main processor 302 also interacts with additional subsystems such as a Random Access Memory (RAM) 306, a flash memory 308, a touch-sensitive display 102, an auxiliary input/output (I/O) subsystem 312, a data port 314, a keyboard 316, a speaker 318, a microphone 320, a GPS receiver 321, short-range communications 322, a camera 323, a accelerometer 325, a magnetometer 327, a gyroscope 329 and other device subsystems 324. Some of the subsystems of the mobile device 100 perform communication-related functions, whereas other subsystems may provide "resident" or on-device functions. By way of example, the display 102 and the keyboard 316 may be used for both communication-related functions, such as entering a text message for transmission over the network 202, and device-resident functions such as a calculator or task list. In one example, the mobile device 100 can include a non touch-sensitive display in place of, or in addition to the touch-sensitive display 102.

The mobile device 100 can send and receive communication signals over the wireless network 202 after required network registration or activation procedures have been completed. Network access is associated with a subscriber or user of the mobile device 100. To identify a subscriber, the mobile device 100 may use a subscriber module component or "smart card" 326, such as a Subscriber Identity Module (SIM), a Removable User Identity Module (RUIM) and a Universal Subscriber Identity Module (USIM). In the example shown, a SIM/RUIM/USIM 326 is to be inserted into a SIM/RUIM/USIM interface 328 in order to communicate with a network. Without the component 326, the mobile device 100 is not fully operational for communication with the wireless network 202. Once the SIM/RUIM/USIM 326 is inserted into the SIM/RUIM/USIM interface 328, it is coupled to the main processor 302.

The mobile device 100 is typically a battery-powered device and includes a battery interface 332 for receiving one or more rechargeable batteries 330. In at least some examples, the battery 330 can be a smart battery with an embedded microprocessor. The battery interface 332 is coupled to a regulator (not shown), which assists the battery 330 in providing power to the mobile device 100. Although current technology makes use of a battery, future technologies such as micro fuel cells may provide the power to the mobile device 100.

The mobile device 100 also includes an operating system 334 and software components 336 to 346 which are described in more detail below. The operating system 334 and the software components 336 to 346 that are executed by the main processor 302 are typically stored in a persistent store such as the flash memory 308, which may alternatively be a read-only memory (ROM) or similar storage element (not shown). Those skilled in the art will appreciate that portions of the operating system 334 and the software components 336 to 346, such as specific device applications, or parts thereof, may be temporarily loaded into a volatile store such as the RAM 306. Other software components can also be included, as is well known to those skilled in the art.

The subset of software applications 336 that control basic device operations, including data and voice communication applications, may be installed on the mobile device 100 during its manufacture. Software applications may include a message application 338, a device state module 340, a Personal Information Manager (PIM) 342, a connect module 344 and an IT policy module 346. A message application 338 can be any suitable software program that allows a user of the mobile device 100 to send and receive electronic messages, wherein messages are typically stored in the flash memory 308 of the mobile device 100. A device state module 340 provides persistence, i.e. the device state module 340 ensures that important device data is stored in persistent memory, such as the flash memory 308, so that the data is not lost when the mobile device 100 is turned off or loses power. A PIM 342 includes functionality for organizing and managing data items of interest to the user, such as, but not limited to, e-mail, contacts, calendar events, and voice mails, and may interact with the wireless network 202.

A connect module 344 implements the communication protocols that are required for the mobile device 100 to communicate with the wireless infrastructure and any host system, such as an enterprise system, that the mobile device 100 is authorized to interface with. An IT policy module 346 receives IT policy data that encodes the IT policy, and may be responsible for organizing and securing rules such as the "Set Maximum Password Attempts" IT policy.

Other types of software applications or components 339 can also be installed on the mobile device 100. These software applications 339 can be pre-installed applications (i.e. other than message application 338) or third party applications, which are added after the manufacture of the mobile device 100. Examples of third party applications include games, calculators, utilities, etc.

The additional applications 339 can be loaded onto the mobile device 100 through at least one of the wireless network 202, the auxiliary I/O subsystem 312, the data port 314, the short-range communications subsystem 322, or any other suitable device subsystem 324.

The data port 314 can be any suitable port that enables data communication between the mobile device 100 and another computing device. The data port 314 can be a serial or a parallel port. In some instances, the data port 314 can be a USB port that includes data lines for data transfer and a supply line that can provide a charging current to charge the battery 330 of the mobile device 100.

For voice communications, received signals are output to the speaker 318, and signals for transmission are generated by the microphone 320. Although voice or audio signal output is accomplished primarily through the speaker 318, the display 102 can also be used to provide additional information such as the identity of a calling party, duration of a voice call, or other voice call related information.

The touch-sensitive display 102 may be any suitable touch-sensitive display, such as a capacitive, resistive, infrared, surface acoustic wave (SAW) touch-sensitive display, strain gauge, optical imaging, dispersive signal technology, acoustic pulse recognition, and so forth, as known in the art. In the presently described example, the touch-sensitive display 102 is a capacitive touch-sensitive display which includes a capacitive touch-sensitive overlay 364. The overlay 364 may be an assembly of multiple layers in a stack which may include, for example, a substrate, a ground shield layer, a barrier layer, one or more capacitive touch sensor layers separated by a substrate or other barrier, and a cover. The capacitive touch sensor layers may be any suitable material, such as patterned indium tin oxide (ITO).

The display 362 of the touch-sensitive display 102 may include a display area in which information may be displayed, and a non-display area extending around the periphery of the display area. Information is not displayed in the non-display area, which is utilized to accommodate, for example, electronic traces or electrical connections, adhesives or other sealants, and/or protective coatings around the edges of the display area.

One or more touches, also known as touch contacts or touch events, may be detected by the touch-sensitive display 102. The processor 302 may determine attributes of the touch, including a location of a touch. Touch location data may include an area of contact or a single point of contact, such as a point at or near a center of the area of contact, known as the centroid. A signal is provided to the controller 366 in response to detection of a touch. A touch may be detected from any suitable object, such as a finger, thumb, appendage, or other items, for example, a stylus, pen, or other pointer, depending on the nature of the touch-sensitive display 102. The location of the touch moves as the detected object moves during a touch. The controller 366 and/or the processor 302 may detect a touch by any suitable contact member on the touch-sensitive display 102. Similarly, multiple simultaneous touches, are detected.

One or more gestures are also detected by the touch-sensitive display 102. A gesture is a particular type of touch on a touch-sensitive display 102 that begins at an origin point and continues to an end point. A gesture may be identified by attributes of the gesture, including the origin point, the end point, the distance travelled, the duration, the velocity, and the direction, for example. A gesture may be long or short in distance and/or duration. Two points of the gesture may be utilized to determine a direction of the gesture.

An example of a gesture is a swipe (also known as a flick). A swipe has a single direction. The touch-sensitive overlay 364 may evaluate swipes with respect to the origin point at which contact is initially made with the touch-sensitive overlay 364 and the end point at which contact with the touch-sensitive overlay 364 ends rather than using each of location or point of contact over the duration of the gesture to resolve a direction.

Examples of swipes include a horizontal swipe, a vertical swipe, and a diagonal swipe. A horizontal swipe typically comprises an origin point towards the left or right side of the touch-sensitive overlay 364 to initialize the gesture, a horizontal movement of the detected object from the origin point to an end point towards the right or left side of the touch-sensitive overlay 364 while maintaining continuous contact with the touch-sensitive overlay 364, and a breaking of contact with the touch-sensitive overlay 364. Similarly, a vertical swipe typically comprises an origin point towards the top or bottom of the touch-sensitive overlay 364 to initialize the gesture, a horizontal movement of the detected object from the origin point to an end point towards the bottom or top of the touch-sensitive overlay 364 while maintaining continuous contact with the touch-sensitive overlay 364, and a breaking of contact with the touch-sensitive overlay 364.

Swipes can be of various lengths, can be initiated in various places on the touch-sensitive overlay 364, and need not span the full dimension of the touch-sensitive overlay 364. In addition, breaking contact of a swipe can be gradual in that contact with the touch-sensitive overlay 364 is gradually reduced while the swipe is still underway.

Meta-navigation gestures may also be detected by the touch-sensitive overlay 364. A meta-navigation gesture is a gesture that has an origin point that is outside the display area of the touch-sensitive overlay 364 and that moves to a position on the display area of the touch-sensitive display. Other attributes of the gesture may be detected and be utilized to detect the meta-navigation gesture. Meta-navigation gestures may also include multi-touch gestures in which gestures are simultaneous or overlap in time and at least one of the touches has an origin point that is outside the display area and moves to a position on the display area of the touch-sensitive overlay 364. Thus, two fingers may be utilized for meta-navigation gestures. Further, multi-touch meta-navigation gestures may be distinguished from single touch meta-navigation gestures and may provide additional or further functionality.

In some examples, an optional force sensor 370 or force sensors is disposed in any suitable location, for example, between the touch-sensitive display 102 and a back of the mobile device 100 to detect a force imparted by a touch on the touch-sensitive display 102. The force sensor 370 may be a force-sensitive resistor, strain gauge, piezoelectric or piezoresistive device, pressure sensor, or other suitable device. Force as utilized throughout the specification refers to force measurements, estimates, and/or calculations, such as pressure, deformation, stress, strain, force density, force-area relationships, thrust, torque, and other effects that include force or related quantities.

Force information related to a detected touch may be utilized to select information, such as information associated with a location of a touch. For example, a touch that does not meet a force threshold may highlight a selection option, whereas a touch that meets a force threshold may select or input that selection option. Selection options include, for example, displayed or virtual keys of a keyboard; selection boxes or windows, e.g., "cancel," "delete," or "unlock"; function buttons, such as play or stop on a music player; and so forth. Different magnitudes of force may be associated with different functions or input. For example, a lesser force may result in panning, and a higher force may result in zooming.

Figure 5:
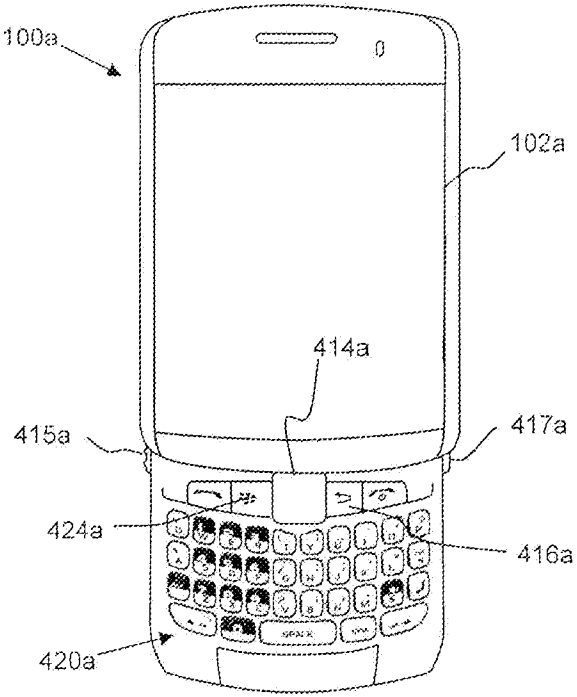
FIG. 5 is a plan view of an example of a mobile device.
Figure 6:
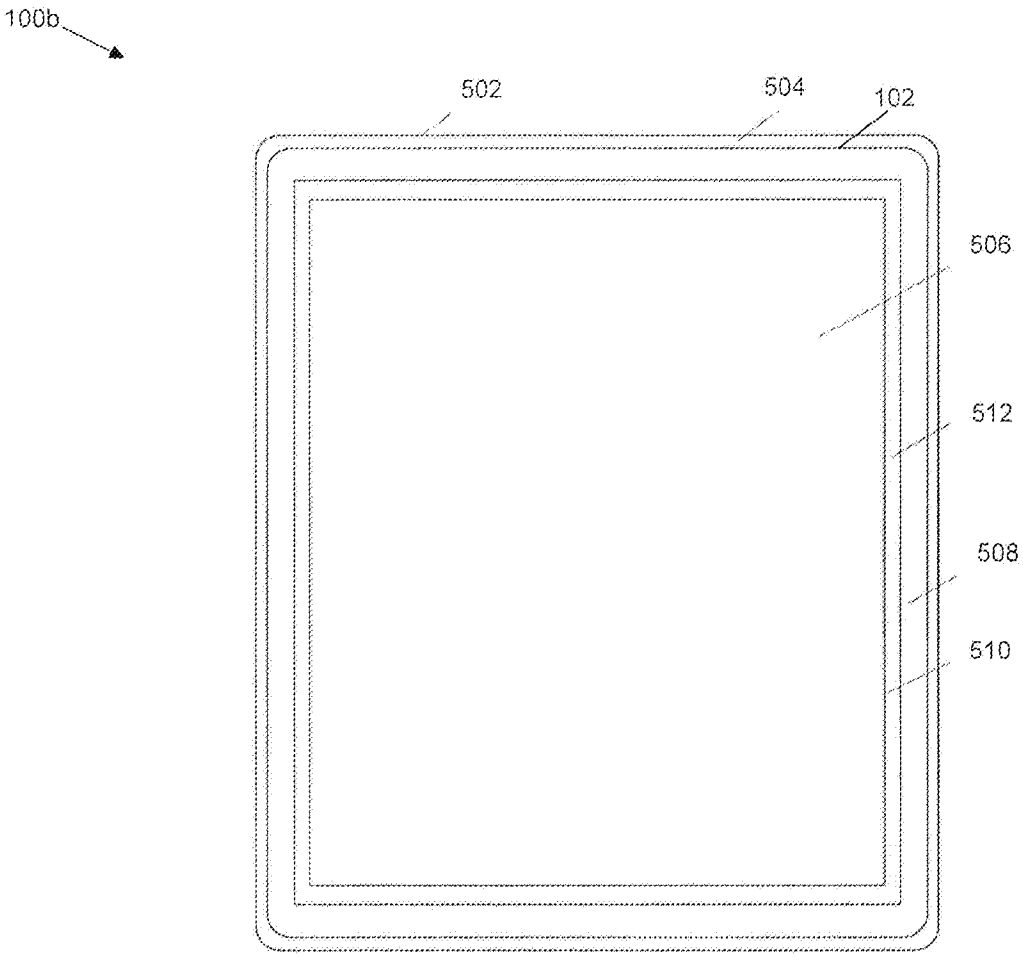
FIG. 6 is a plan view of another example of a mobile device.

Referring to FIGS. 5 and 6, one example of a mobile device 100*a* is shown in FIG. 5 and another example of a mobile device 100*b* is shown in FIG. 6. It will be appreciated that the numeral "100" will hereinafter refer to any mobile device 100, including the examples 100*a* and 100*b*, those examples enumerated above or otherwise. It will also be appreciated that a similar numbering convention may be used for other general features common between all figures.

The mobile device 100*a* shown in FIG. 5 includes a touch-sensitive display 102*a* and a cursor or positioning device, which in this example is in the form of a trackpad 414*a*. In this example, a touch-sensitive display area spans the entire touch-sensitive display 102*a*. The trackpad 414*a* permits multi-directional positioning of a selection indicator or cursor that can be displayed on the touch-sensitive display 102*a* such that the selection cursor can be moved in an upward, downward, left and right direction, and if desired and/or permitted, in any diagonal direction. A selection cursor may include a box, alteration of an icon or any combination of features that enable the user to identify the currently chosen icon or item. The trackpad 414*a* in this example is situated on the front face of a housing for mobile device 100*a* to enable a user to manoeuvre the trackpad 414*a* while holding the mobile device 100*a* in one hand. The trackpad 414*a* may serve as another input member (in addition to a directional or positioning member) to provide selection inputs to a processor of the mobile device and can preferably be pressed in a direction towards the housing of the mobile device 100*a* to provide such a selection input. It will be appreciated that the trackpad 414*a* is only one example of a suitable positioning device. For example, a trackball, touch-sensitive display, OLED, or other input mechanism may equally apply.

The mobile device 100*a* in FIG. 5 also includes a programmable convenience button 415*a* to activate a selection application such as, for example, a calendar or calculator. Further, mobile device 100*a* also includes an escape or cancel button 416*a*, a camera button 417*a*, a menu or option button 424*a* and a keyboard 420*a*. The camera button 417*a* is able to activate photo and video capturing functions, e.g. when pressed in a direction towards the housing. The menu or option button 424*a* can be used to load a menu or list of options on the display 102*a* when pressed. In this example, the escape or cancel button 416*a*, the menu option button 424*a*, and a keyboard 420*a* are disposed on the front face of the mobile device housing, while the convenience button 415*a* and camera button 417*a* are disposed at the side of the housing. This button placement enables a user to operate these buttons while holding the mobile device 100*a* in one hand. The keyboard 420*a* is, in this example, a standard QWERTY keyboard, however, it will be appreciated that reduced QWERTY or virtual keyboards (e.g. as provided by a touch-sensitive display) may equally apply.

It will be appreciated that for the mobile device 100, a wide range of one or more positioning or cursor/view positioning mechanisms such as a touch/track pad, a positioning wheel, a joystick button, a mouse, a touch-sensitive display, a set of arrow keys, a tablet, an accelerometer (for sensing orientation and/or movements of the mobile device 100 etc.), OLED, or other whether presently known or unknown may be employed. Similarly, any variation of keyboard 420*a* may be used. It will also be appreciated that the mobile devices 100 shown in FIGS. 5 and 6 are for illustrative purposes only and various other mobile devices 100 are equally applicable to the following examples. Other buttons may also be disposed on the mobile device housing such as colour coded "Answer" and "Ignore" buttons to be used in telephonic communications.

A front view of an example of the mobile device 100*b* is shown in FIG. 6. The mobile device 100*b* includes a housing 502 that encloses components such as shown in FIG. 4. The housing 502 may include a back, sidewalls, and a front 504 that frames the touch-sensitive display 102. The example mobile device 100*b* shown in FIG. 6 can represent a portable tablet computer or other handheld or otherwise portable device.

In the example of FIG. 6, the touch-sensitive display 102 is generally centered in the housing 502 such that a display area 506 of the touch-sensitive overlay 364 is generally centered with respect to the front 504 of the housing 502. The non-display area 508 of the touch-sensitive overlay 364 extends around the display area 506. In the presently described example, the width of the non-display area is 4 mm. In one example, the touch-sensitive display area 122 and the touch-sensitive non-display area 124 of FIGS. 1A and 1B can be implemented as a display area 506 of the touch-sensitive overlay 364 and a non-display area 508 of the touch-sensitive overlay 364, respectively.

For the purpose of the present example, the touch-sensitive overlay 364 extends to cover the display area 506 and the non-display area 508. Touches on the display area 506 may be detected and, for example, may be associated with displayed selectable features. Touches on the non-display area 508 may be detected, for example, to detect a meta-navigation gesture. Alternatively, meta-navigation gestures may be determined by both the non-display area 508 and the display area 506. The density of touch sensors may differ from the display area 506 to the non-display area 508. For example, the density of nodes in a mutual capacitive touch-sensitive display, or density of locations at which electrodes of one layer cross over electrodes of another layer, may differ between the display area 506 and the non-display area 508.

Gestures received on the touch-sensitive display 102 may be analyzed based on the attributes to discriminate between meta-navigation gestures and other touches, or non-meta navigation gestures. Meta-navigation gestures may be identified when the gesture crosses over a boundary near a periphery of the display 362, such as a boundary 510 between the display area 506 and the non-display area 508. In the example of FIG. 6, the origin point of a meta-navigation gesture may be determined utilizing the area of the touch-sensitive overlay 364 that covers the non-display area 508.

A buffer region 512 or band that extends around the boundary 510 between the display area 506 and the non-display area 508 may be utilized such that a meta-navigation gesture is identified when a touch has an origin point outside the boundary 510 and the buffer region 512 and crosses through the buffer region 512 and over the boundary 510 to a point inside the boundary 510. Although illustrated in FIG. 6, the buffer region 512 may not be visible. Instead, the buffer region 512 may be a region around the boundary 510 that extends a width that is equivalent to a predetermined number of pixels, for example. Alternatively, the boundary 510 may extend a predetermined number of touch sensors or may extend a predetermined distance from the display area 506. The boundary 510 may be a touch-sensitive region or may be a region in which touches are not detected.

Gestures that have an origin point in the buffer region 512, for example, may be identified as non-meta navigation gestures. Optionally, data from such gestures may be utilized by an application as a non-meta navigation gesture. Alternatively, data from such gestures may be discarded such that touches that have an origin point on the buffer region 512 are not utilized as input at the mobile device 100.

Figure 7:
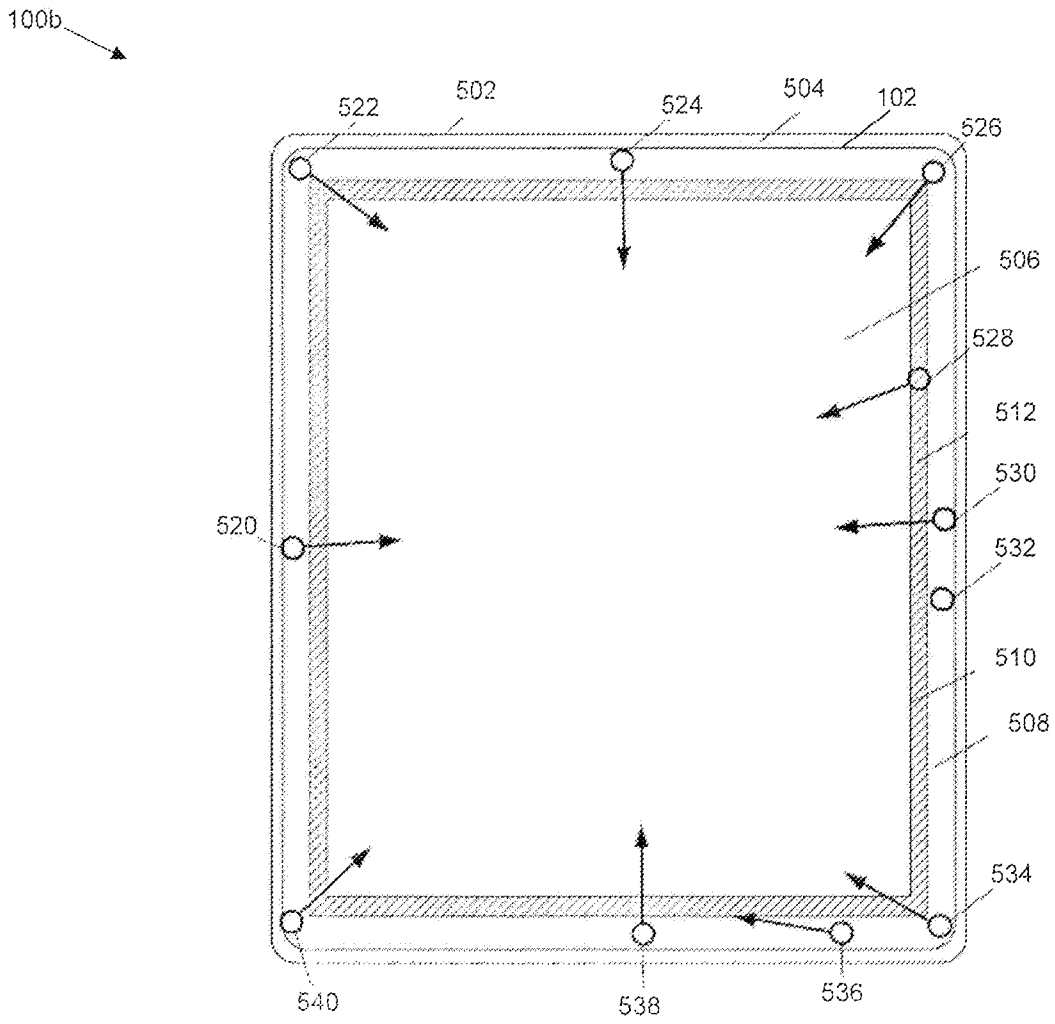
FIG. 7 is a plan view of example gestures on the mobile device of FIG. 6.

FIG. 7 illustrates examples of touches on the touch-sensitive display 102. The buffer region 512 is illustrated in FIG. 7 by hash markings for the purpose of explanation. As indicated, the buffer region 512 may not be visible to the user. For the purpose of explanation, touches are illustrated by circles at their points of origin. Arrows extending from the circles illustrate the paths of the touches that are gestures.

The touch 538 begins at the origin point outside the boundary 510 and outside the buffer region 512. The path of the touch 538 crosses the buffer region 512 and the boundary 510 and is therefore identified as a meta-navigation gesture. Similarly, the touches 520, 530, 524, 522, 526, 540, 534 each have origin points outside the boundary 510 and the buffer region 512 and their paths cross the buffer region 512 and the boundary 510. Each of the touches 520, 530, 524, 522, 526, 540, 534 is therefore identified as a meta-navigation gesture. The touch 528, however, has an origin point that falls within the buffer region 512 and the touch 528 is therefore not identified as a meta-navigation gesture. The touch 536 begins at an origin point outside the boundary 510 and the buffer region 512. The path of the touch 536, however, does not cross the boundary 510 and is therefore not identified as a meta-navigation gesture. The touch 532 also has an origin point outside the boundary 510 and the buffer region 512 but is not a gesture and therefore does not cross the boundary 510 and is not identified as a meta-navigation gesture.

Figure 8:
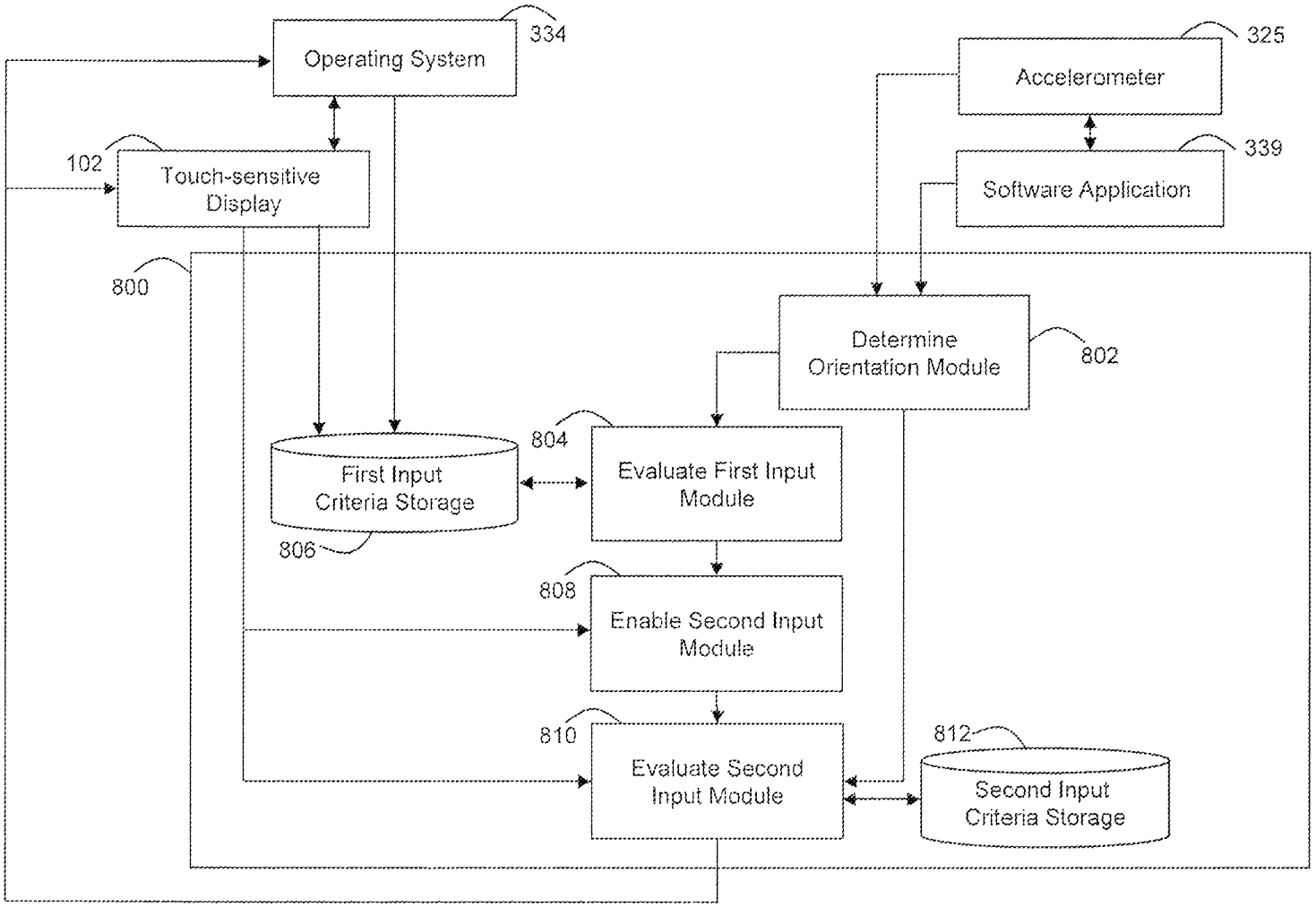
FIG. 8 is a diagram of an example configuration of a display orientation application.

Referring to FIG. 8, an example of a configuration for a display orientation application 800 is provided. The display orientation application 800 can be one of the other software applications 339 of FIG. 4 that can be loaded on the mobile device 100. The display orientation application 800 can request details of activity occurring in, or receive inputs from, a component that can be used to determine the orientation of the mobile device 100, such as a reading from one or more sensors of the mobile device 100 (e.g. accelerometer reading), or a software application 339 that provides that orientation of the mobile device (e.g. in the form of an orientation matrix). The display orientation application 800 can also request or receive information regarding the criteria used for changing the display orientation from other components that can change the display orientation, such as the operating system 334. The display orientation application 800 can also receive inputs from other components that can be used to determine properties of the display of the mobile device 100, such as the touch-sensitive display 102 and operating system 334. The display orientation application 800 can also receive inputs from one or more input mechanisms of the mobile device 100, such as touch gestures from the touch-sensitive display 102. Based on the inputs detected by the mobile device 100, the display orientation application 800 can instruct or otherwise cause the touch-sensitive display 102 to change the display orientation.

The display orientation application 800 in the example of FIG. 8 includes a determine orientation module 802 for determining an orientation of the mobile device 100. The display orientation application 800 also includes an evaluate first input module 804 for evaluating one or more properties of the orientation of the mobile device 100 based on one or more criteria stored in the first input criteria storage 806. The display orientation application 800 also includes an enable second input module 808 for enabling a second input to change the display orientation. The display orientation application also includes an evaluate second input module 810 for evaluating one or more properties of a second input based on criteria stored in the second input criteria storage 812 and for changing the display orientation of the touch-sensitive display 102 if the second input satisfies the criteria in the second input criteria storage 812.

The determine orientation module 802 determines a current orientation of the mobile device 100. In an example, the determine orientation module 802 can determine the orientation of the mobile device 100 from information provided by other components, such as obtaining an accelerometer reading of the gravity reference direction 104 from an accelerometer 325 and comparing the gravity reference direction 104 to a frame of reference of the mobile device 100 (eg. x and y axes of FIG. 1). In another example, the determine orientation module 802 can generate an orientation matrix from readings from multiple sensors, such as a magnetic north reference direction and gravity reference direction obtained from a magnetometer 327 and an accelerometer 325, respectively, or from other methods or techniques available on the mobile device 100. In another example, the determine orientation module 802 can obtain the orientation from a component that has determined the orientation of the mobile device 100, such as a software application 339 that generates an orientation matrix.

The evaluate first input module 804 receives the orientation of the mobile device 100 from the determine orientation module 802 and evaluates one or more properties of the orientation of the mobile device 100. The evaluate first input module 804 determines whether the orientation of the mobile device 100 satisfies one or more criteria stored in the first input criteria storage 806 to determine whether the orientation of the mobile device 100 is a first input that is associated with triggering a change in the display orientation of the touch-sensitive display 102. Referring back to the example of FIG. 1, the criteria may be that the orientation of the mobile device 100 is such that the angle θ has decreased to less than a predetermined value (e.g. 30 degrees). It will be appreciated that the evaluate first input module 804 can evaluate one or more properties associated with the orientation of the mobile device 100 including its orientation with respect to a reference direction or a particular frame of reference, or a change in orientation of the mobile device 100 over a particular time period.

The first input criteria storage 806 stores criteria used to evaluate the orientation of the mobile device 100. In one example, the first input criteria storage 806 can be provided or obtained from one or more components that change the display orientation, such as a user interface subsystem of the operating system 334 or a software application 339 running on the mobile device 100. In another example, the criteria can be preloaded in the first input criteria storage 806.

The enable second input module 808 enables a second input to change the display orientation. In an example embodiment, enabling a second input to change the display orientation of the touch-sensitive display 102 requires additional criteria to be satisfied, such as an absence of a change in the display orientation in response to the first input.

The evaluate second input module 810 receives a second input and evaluates one or more properties of the second input. In an example, the second input can be in the form of an orientation of the mobile device 100, as provided by the determine orientation module 802. In another example, the second input can be provided by an input mechanism of the mobile device 100, such as a touch gesture detected by the touch-sensitive display 102. The evaluate second input module 810 evaluates one or more properties of the second input based on one or more criteria stored in the second input criteria storage 812. In the example of FIG. 2, the criteria stored in the second input criteria storage 812 can include properties of a shake motion 108 such that comparison of the second input against the criteria stored in the second input criteria storage 812 can determine whether the second input is a shake motion 108. Upon determining that the second input satisfies criteria stored in the second input criteria storage 812, the evaluate second input module 810 can instruct or otherwise cause the touch-sensitive display 102 to change the display orientation.

It will be appreciated that any module, subsystem or component exemplified herein that executes instructions or operations may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data, except transitory propagating signals per se. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the mobile device 100 or accessible or connectable thereto. Any application or module herein described may be implemented using computer readable/executable instructions or operations that may be stored or otherwise held by such computer readable media.

Figure 9:
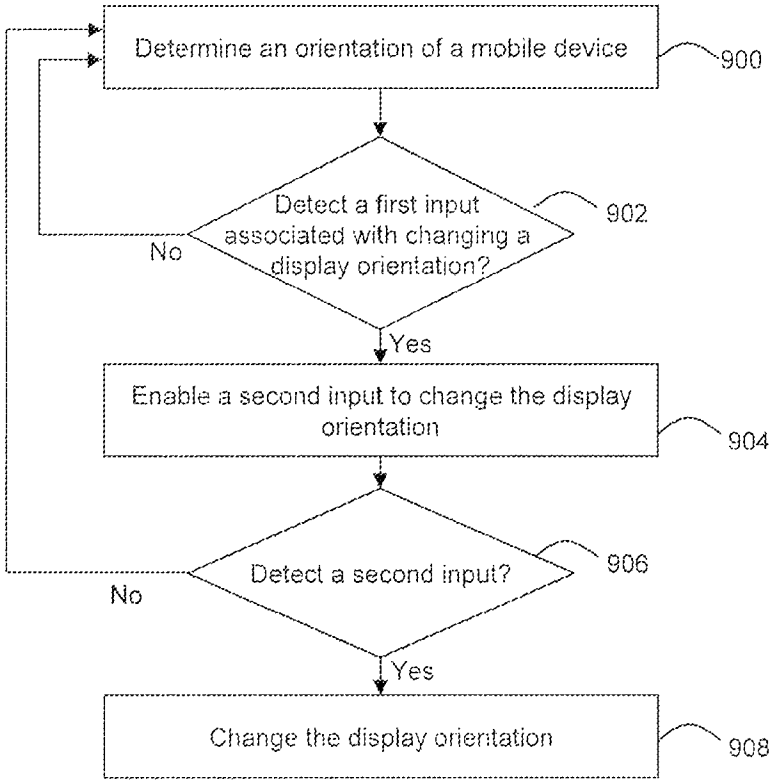
FIG. 9 is a flow diagram of an example of computer executable instructions for determining a display orientation of a mobile device.

Referring to FIG. 9, an example set of computer executable instructions is provided for determining a display orientation of an electronic device, such as a mobile device 100. At 900, an orientation of the mobile device 100 is determined. At 902, a check is performed to determine whether a first input associated with changing the display orientation of the mobile device 100 is detected. If a first input is detected at 902, a second input is enabled to change the display orientation at 904. At 906, a check is performed to determine whether the second input is detected. If a second input is detected at 906, the display orientation changes at 908. If the check at 902 or 902 does not detect a first input or second input, respectively, the operation at 900 can be repeated.

As noted above, at 900, an orientation of the mobile device 100 is determined. In an example configuration of the display orientation application 800, the determine orientation module 802 may implement 900 (FIG. 8). It will be appreciated that the orientation of the mobile device 100 can be determined from any method or technique available on the mobile device 100. In one example, the orientation of the mobile device 100 may be derived from one or more sensor readings (e.g. accelerometer reading to determine the angle θ). In another example, the orientation of the mobile device 100 may be obtained from an orientation matrix or other data describing the orientation of the mobile device 100. The orientation matrix may be generated from a combination of sensor readings, such as the magnetic north direction and the gravity reference direction 104, as obtained from a magnetometer 327 and accelerometer 325, respectively.

At 902, a check is performed to determine whether a first input associated with changing the display orientation of the mobile device 100 is detected. The check can be performed by evaluating the orientation of the mobile device 100 against one or more criteria associated with changing the display orientation of the mobile device 100. In an example configuration of the display orientation application 800, the evaluate first input module 804 may implement 902 based on one or more criteria stored in the first input criteria storage 806 (FIG. 8). As illustrated in the example of FIG. 1, the criteria can include orienting the mobile device to a specific position with respect to a reference direction, such as an angle θ less than 30 degrees with the gravity reference direction 104.

In another example, the criteria may also include the current display orientation of the mobile device 100. For example, when the touch-sensitive display 102 is configured to a portrait orientation (e.g. position A of FIG. 1), the criteria may include that the angle θ is less than 30 degrees to ensure that the display orientation changes only when the orientation of the mobile device 100 is close to a landscape orientation. When the touch-sensitive display 102 is configured to a landscape orientation (e.g. position B of FIG. 1), the criteria to change the display orientation to a portrait orientation may include that the angle θ is greater than 60 degrees to ensure that the display orientation changes only when the orientation of the mobile device 100 is close to a portrait orientation.

It will be appreciated that that other criteria can be used to trigger a change in the display orientation. In another example, the operating system 334 or other software application 339 controlling the graphical user interface may determine the criteria used to trigger a change in the display orientation.

At 904, a second input is enabled to change the display orientation. In an example configuration of the display orientation application 800, the enable second input module 808 may implement 904 (FIG. 8).

At 906, a check is performed to determine whether a second input to change the display orientation is detected. The check can be performed by evaluating an input of the mobile device 100 against one or more criteria that defines the second input. In an example configuration of the display orientation application 800, the evaluate second input module 804 may implement 906 based on one or more criteria stored in the second input criteria storage 812 (FIG. 8).

In one example, the second input can be a type of input that is different from that of the first input. In the example of FIGS. 1 and 2, the first input includes a rotation 106 of the mobile device 100 of approximately 90 degrees whereas the second input includes a more limited movement, such as a shaking motion 108 within a range of approximately 40 degrees. In this example, the shaking motion 108 can be performed by the hand 110 of a user holding the mobile device 100.

Figure 10:
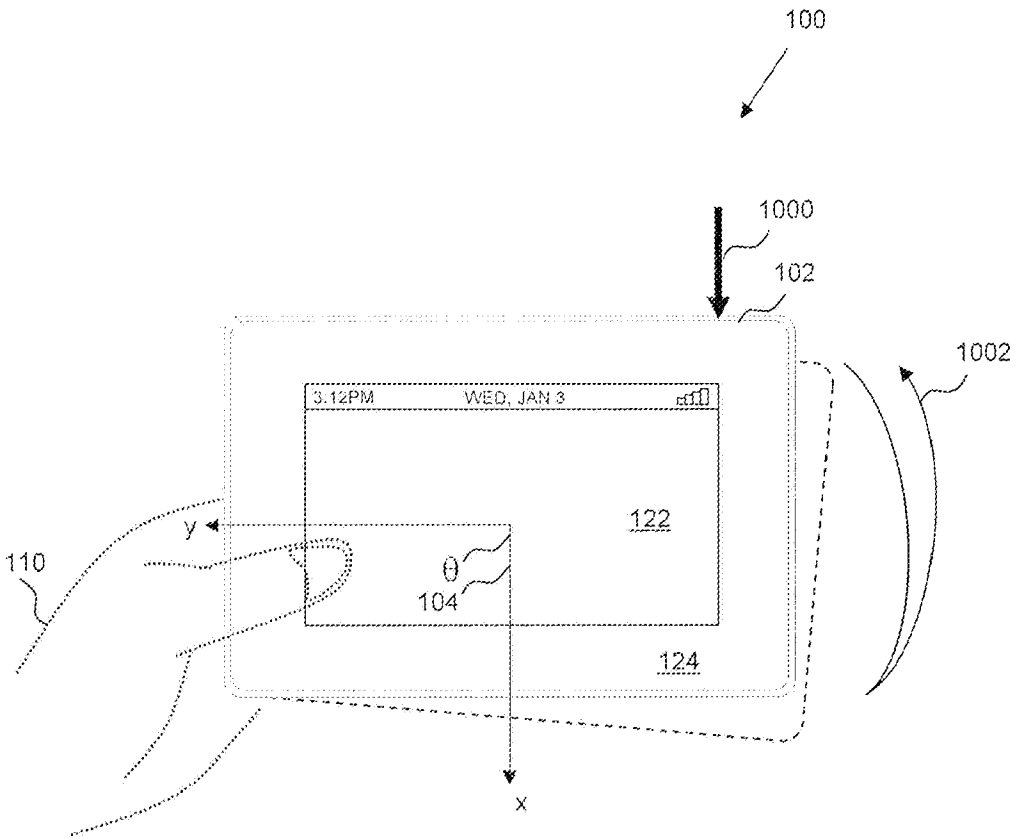
FIG. 10 is a plan view of an example of a mobile device receiving another input in the form of a dip motion.

In another example, the second input can include a dip motion 1002 where the mobile device 100 dips downwards before returning to its original position (FIG. 10). For example, a dip motion 1002 can be performed by applying a tap or nudge 1000 on a corner periphery of the mobile device 100 using the index finger of the opposite hand holding the mobile device 100. The motions 108 and 1002 may be detected by the mobile device 100 by monitoring the fluctuation in the angle θ with respect to the gravity reference direction 104.

Figure 11:
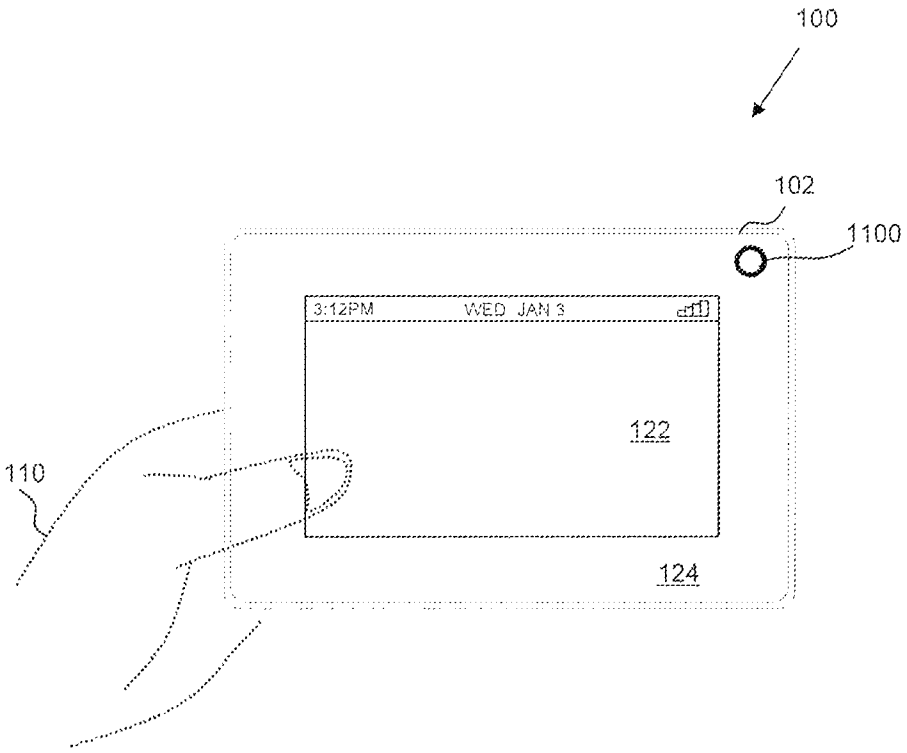
FIG. 11 is a plan view of an example of a mobile device receiving another input in the form of a touch gesture.

In another example, the second input can include a touch gesture, such as the tap gesture 1100, on the touch-sensitive display 102. In the example of FIG. 11, the tap gesture 1100 is applied to the touch-sensitive non-display area 124. In this example, movement of the mobile device 100 is not required to detect the second input.

In another example, the mobile device 100 may be configured to require the second input to be detected within a predetermined period of time after the first input such that the second input may be used to perform functions other than changing the display orientation when not proceeding the first input within the predetermined time period. This can enable the mobile device 100 to use of the same type of input (e.g. tap gesture 1100) for different functions, thus maximizing use of quick and easily performed inputs on the mobile device 100.

It will be appreciated that the second input can be any type of input that can be received or detected by the mobile device 100 including a change in orientation of the mobile device 100, touch gesture, keyboard input, voice command, etc.

Referring back to FIG. 9, at 908, the display orientation changes if a second input is detected. In an example configuration of the display orientation application 800, the evaluate second input module 810 may implement 908 (FIG. 8).

Figure 12:
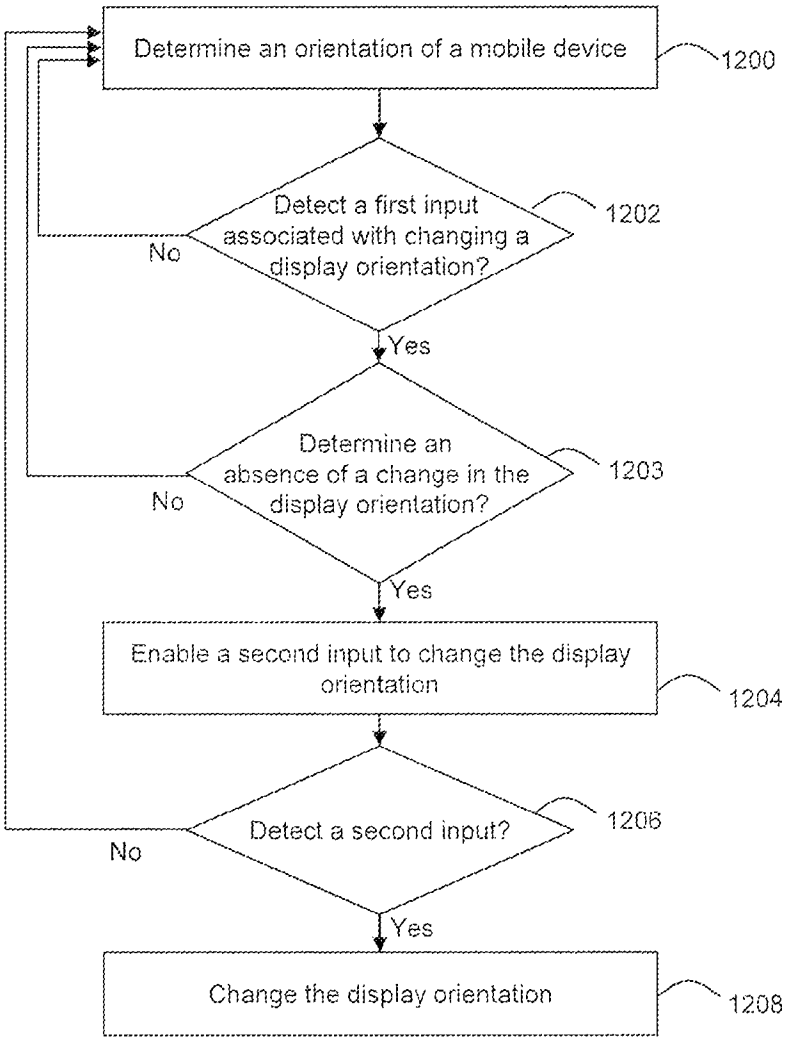
FIG. 12 is a flow diagram of another example of computer executable instructions for determining a display orientation of a mobile device.

Referring to FIG. 12, another example set of computer executable instructions is provided for determining a display orientation of an electronic device, such as a mobile device 100. At 1200, an orientation of the mobile device 100 is determined. At 1202, a check is performed to determine whether a first input associated with changing the display orientation of the mobile device 100 is detected. If a first input is detected at 1202, a check is performed to determine whether the display orientation changed in response to the first input at 1203. If the display orientation did not change, a second input is enabled to change the display orientation at 1204. At 1206, a check is performed to determiner whether the second input is detected. If a second input is detected at 1206, the display orientation changes at 1208. If the check at 1202, 1203 or 1202 are not satisfied, the operation at 1200 can be repeated.

Operations 1200, 1202, 1204, 1206 and 1208 are substantially similar to 900, 902, 904, 906 and 908, as described above.

As noted above, at 1203, a check is performed to determine whether the display orientation changed in response to the first input. In an example configuration of the display orientation application 800, the enable second input module 808 may implement 1203 by monitoring the activity of the touch-sensitive display 102 (FIG. 8). An absence of a change in the display orientation within a predetermined period of time after detecting the first input may suggest that the mobile device 100 has encountered an error in failing to change the display orientation and/or result in the display orientation not being optimal for viewing by the user.

Figure 13:
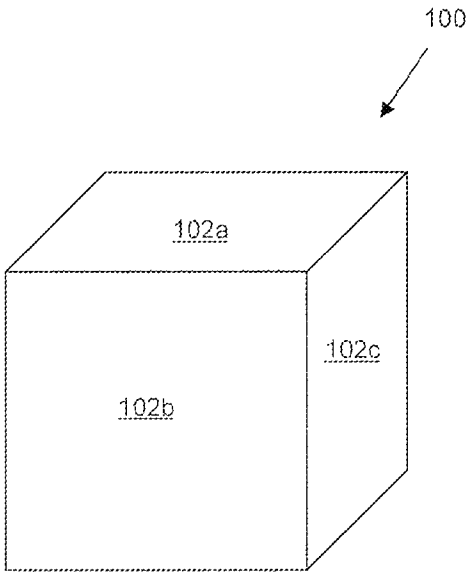
FIG. 13 is a perspective view of another example of a mobile device.
Figure 14:
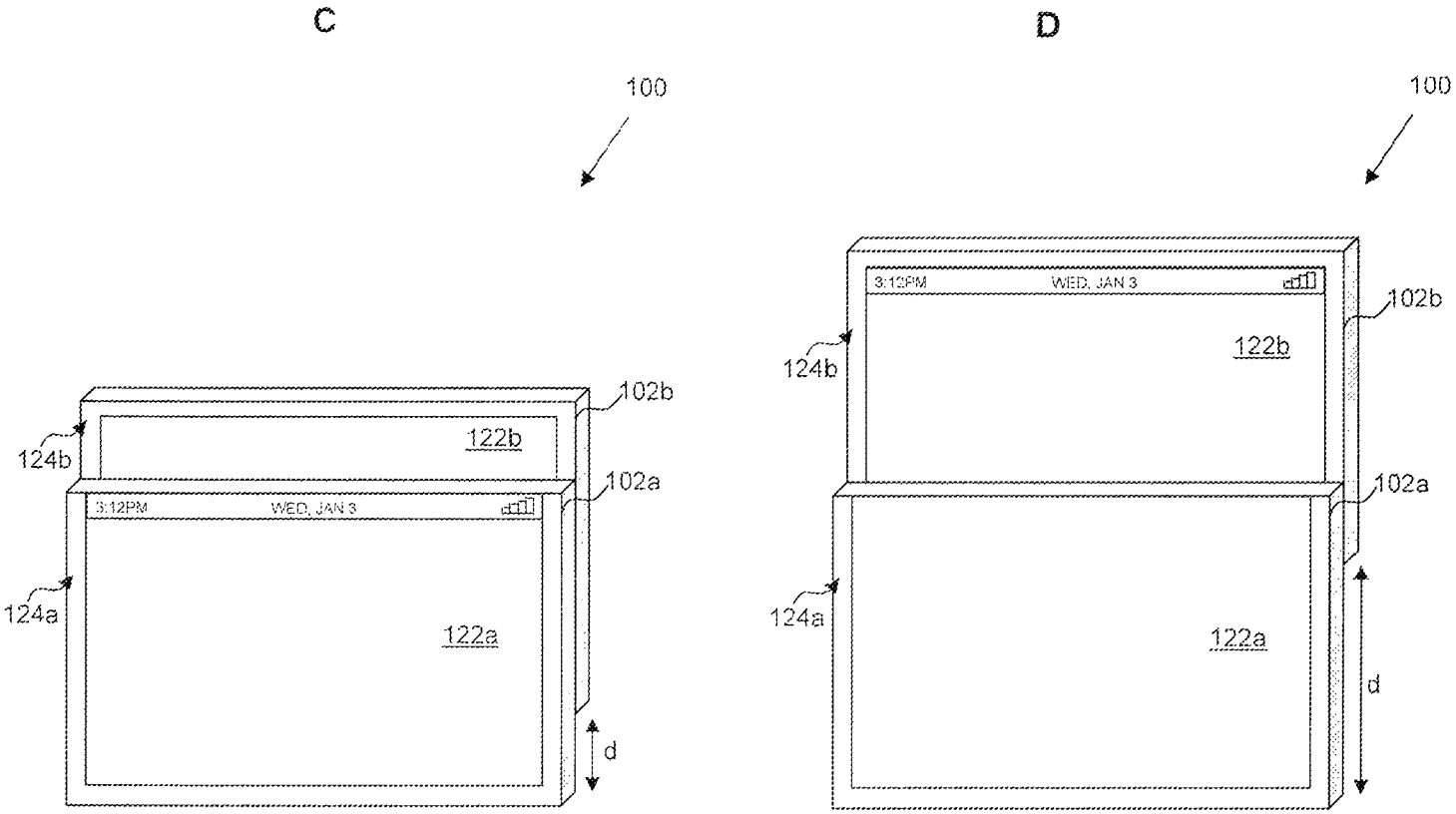
FIG. 14 is a perspective view of another example of a mobile device in different orientations.

It will be appreciated that the mobile device 100 can take on a various shapes and form factors, including planar devices and other 3D shapes having a plurality of faces. The mobile device 100 may also include more than one display, such as a touch-sensitive display 102 located on one or more faces of the mobile device 100. In the example of FIG. 13, a mobile device 100 is shown having a cubic shape with a plurality of touch-sensitive displays 102*a*-102*c*. The display orientation of each touch-sensitive display 102*a*-102*c* can be controlled by its own display orientation application 800, a common display orientation application 800 or a combination thereof.

It will also be appreciated that the display of the mobile device 100, such as the touch-sensitive display 102, may also take on various shapes such as rectangular, hexagonal, circular, etc. The touch-sensitive display 102 may also include one or more faces that can be configured, positioned, retracted, folded, bent or otherwise manipulated into various shapes and orientations.

In FIG. 13, an example mobile device 100 including a "slide-out" display is provided. The slide out display includes a touch-sensitive display 102*b* which can slide a distance d away from another touch-sensitive display 102*a*. At position C, the mobile device 100 is oriented such that the touch-sensitive display 102*b* is retracted to a distance d below a threshold value to deactivate the touch-sensitive display area 122*b*, resulting in a landscape orientation of the touch-sensitive display area 122*a*. At position D, the mobile device 100 is oriented such that the touch-sensitive display 102*b* is extended a distance d that is above the threshold value to activate the touch-sensitive display area 122*b*. The increased total viewable area of the touch-sensitive display areas 122*a* and 122*b* accommodates a portrait display orientation across the combined touch-sensitive display areas 122*a* and 122*b*.

In the example of FIG. 13, a first input can include extending the touch-sensitive display 102*b* from position C to position D to trigger a change in the display orientation from a landscape orientation to a portrait orientation. In one example, failure to change the display orientation in response to extending the touch-sensitive display 102*b* away from the touch-sensitive display 102*a* can enable a second input to change the display orientation, such as a shaking motion 108, dipping motion 1002, tapping gesture 1100, or another input detectable by the mobile device 100, as described above. The orientation of the mobile device 100, as defined by the distance d between the touch-sensitive displays 102*a* and 102*b*, can be determined by a linear potentiometer of the mobile device 100. It will be appreciated that the orientation of a mobile device 100 can be determined by a combination of sensors or other measurement devices (e.g. potentiometer) available on the mobile device 100.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

The steps or operations in the flow charts and diagrams described herein are just for example. There may be many variations to these steps or operations without departing from the spirit of the invention or inventions. For instance, the steps may be performed in a differing order, or steps may be added, deleted, or modified.

Although the above has been described with reference to certain specific examples, various modifications thereof will be apparent to those skilled in the art as outlined in the appended claims.

The invention claimed is:

1. A method of determining a display orientation of a mobile device, the mobile device configured to change the display orientation from a first orientation to an expected orientation in response to detection of a first input, the method comprising:

detecting the first input during a current operating state of the mobile device;

in response to detecting the first input, determining that the first input satisfies one or more first criteria defined for the current operating state, wherein satisfaction of the one or more first criteria during the current operating state triggers a process for changing display orientation of the mobile device from a first orientation to the expected orientation during the current operating state;

in response to determining that the first input satisfies the one or more first criteria, detecting, during the current operating state, an absence of a change in the display orientation from the first orientation to the expected orientation in response to the first input; and in response to detecting the absence of a change in the display orientation, enabling, during the current operating state, detection of a second input to change the display orientation to the expected orientation, wherein enabling detection of the second input is triggered by detecting the absence of the change in the display orientation based on the first input;

in response to detecting the second input within a predetermined period of time after detecting the first input, changing the display orientation from a first orientation to the expected orientation, the second input comprising a movement of the mobile device within a range smaller than the first input.

2. The method of claim 1, further comprising:

detecting the second input within the predetermined period of time; and changing the display orientation to the expected orientation upon detecting the second input.

3. The method of claim 1, wherein the second input comprises any one of: shaking the mobile device, and nudging the mobile device.

4. The method of claim 1, wherein the one or more first criteria comprises orientating the mobile device to a specific position with respect to a reference direction.

5. The method of claim 1, wherein the one or more first criteria comprises changing the orientation of the mobile device between a portrait orientation and a landscape orientation.

6. The method of claim 1, wherein the display orientation changes between a landscape orientation and a portrait orientation.

7. A non-transitory computer readable storage medium for determining a display orientation of a mobile device, the mobile device configured to change the display orientation from a first orientation to an expected orientation in response to detection of a first input, the computer readable storage medium comprising computer executable instructions for:

detecting the first input during a current operating state of the mobile device;

in response to detecting the first input, determining that the first input satisfies one or more first criteria defined for the current operating state, wherein satisfaction of the one or more first criteria during the current operating state triggers a process for changing display orientation of the mobile device from a first orientation to the expected orientation during the current operating state;

in response to determining that the first input satisfies the one or more first criteria, detecting, during the current operating state, an absence of a change in the display orientation from the first orientation to the expected orientation in response to the first input; and in response to detecting the absence of a change in the display orientation, enabling, during the current operating state, detection of a second input to change the display orientation to the expected orientation, wherein enabling detection of the second input is triggered by detecting the absence of the change in the display orientation based on the first input;

in response to detecting the second input within a predetermined period of time after detecting the first input, changing the display orientation from a first orientation to the expected orientation, the second input comprising a movement of the mobile device within a range smaller than the first input.

8. The non-transitory computer readable medium of claim 7, further comprising computer executable instructions for:

detecting the second input within the predetermined period of time; and changing the display orientation to the expected orientation upon detecting the second input.

9. The non-transitory computer readable medium of claim 7, wherein the second input comprises any one of: shaking the mobile device, and nudging the mobile device.

10. A mobile device comprising a processor and memory, the mobile device configured to change the display orientation from a first orientation to an expected orientation, the memory storing computer executable instructions for:

detecting a first input during a current operating state of the mobile device, wherein the first input satisfies one or more criteria defined for the current operating state to trigger a process for changing display orientation of the mobile device from a first orientation to the expected orientation during the current operating state;

determining the display orientation in response to the first input is not the expected orientation during the current operating state; and enabling, during the current operating state, a second input to change the display orientation from a first orientation to the expected orientation when detected within a predetermined period of time after detecting the first input, the second input being enabled to change the display orientation in response to detecting the absence of the change in the display orientation based on the first input, wherein the second input is of a different type than the first input and comprises a movement of the mobile device within a range smaller than the first input, and wherein after the predetermined period time the second input no longer changes the display orientation to the expected orientation.

11. The mobile device of claim 10, wherein the memory further stores computer executable instructions for:

detecting the second input within the predetermined period of time; and changing the display orientation to the expected orientation upon detecting the second input.

12. The mobile device of claim 10, wherein the second input comprises any one of: shaking the mobile device, and nudging the mobile device.

* * * * *